US005355825A

United States Patent [19]

Lefebvre et al.

[11] Patent Number: 5,355,825

[45] Date of Patent: Oct. 18, 1994

[54] MULTIPURPOSE FLOTATION DEVICE

[75] Inventors: Ronald R. Lefebvre; Robert J. Cowan, both of Saskatoon; Warren D. Jeschke, Hepburn; Allan R. McCubbing, Saskatoon, all of Canada

[73] Assignee: Free Form Plastic Products Inc., Saskatoon, Canada

[21] Appl. No.: 91,584

[22] Filed: Jul. 15, 1993

[30] Foreign Application Priority Data

Jul. 8, 1992 [CA] Canada ..... 2073425

[51] Int. Cl.[5] ..... B63B 35/44

[52] U.S. Cl. ..... 114/267; 114/263

[58] Field of Search ..... 114/263, 266, 267; 405/219, 171

[56] References Cited

U.S. PATENT DOCUMENTS

| | | | |
|---|---|---|---|
| 3,654,885 | 4/1972 | Godbersen . | |
| 3,752,102 | 8/1973 | Shuman . | |
| 4,037,420 | 7/1977 | Wicks . | |
| 4,365,577 | 12/1982 | Heinrich | 114/267 |
| 4,418,634 | 12/1983 | Gerbus . | |
| 4,768,456 | 9/1988 | Jones et al. . | |
| 4,867,093 | 9/1989 | Sullivan . | |
| 4,928,617 | 5/1990 | Meriwether . | |
| 4,974,538 | 12/1990 | Meriwether . | |
| 5,125,353 | 6/1992 | McGuinness . | |

FOREIGN PATENT DOCUMENTS

| | | |
|---|---|---|
| 344627 | 4/1974 | Canada . |
| 948933 | 6/1974 | Canada . |
| 953163 | 8/1974 | Canada . |
| 1083840 | 8/1980 | Canada . |
| 1220671 | 4/1987 | Canada . |
| 1233704 | 3/1988 | Canada . |
| US87/01979 | 8/1987 | PCT Int'l Appl. . |

*Primary Examiner*—Jesus D. Sotelo

*Attorney, Agent, or Firm*—Murray E. Thrift; Adrian D. Battison; Stanley G. Ade

[57] ABSTRACT

A multipurpose aquatic float has a molded shell of plastic resin. The float has a generally rectangular base part with a set of integral mounting flanges on its top surface. The mounting flanges are arranged to provide a longitudinal center channel for accepting a framing member of standard dimension lumber. Transverse flanges support the longitudinal flanges and provide a cross channel at the center and end notches to accommodate cross bracing in the frame on which the float is mounted. The longitudinal flanges have molded-in fastener receivers for receiving fasteners that secure the float in place on the framework of the support structure.

21 Claims, 7 Drawing Sheets

MULTIPURPOSE FLOTATION DEVICE

FIELD OF THE INVENTION

The present invention relates to aquatic floats for supporting other structures, for example, docks, platforms or platform boats.

BACKGROUND

A number of types of floating devices have been used or proposed for use with docks, platforms and the like. These have several disadvantages:

1. Metal drums can rust, leak and contaminate the water; they are heavy;
2. Rigid foam can deteriorate over time and break up into small particles;
3. Foam filled automobile tires are expensive relative to the amount of flotation capacity they provide. They are heavy.
4. Plastic dock flotation systems are expensive, generally single purpose and not suited for building a structure upon. These are generally systems obliging the user to use all parts of the system.

SUMMARY

The present invention alms at the provision of a novel multipurpose float with various advantages over those now used.

According to the present invention there is provided an aquatic float comprising a molded shell of plastic resin having a base part with longitudinally spaced ends and transversely spaced sides, and a plurality of integral frame mounting elements on the top of the base part, the mounting elements including transversely spaced apart longitudinal flanges defining a centre channel for receiving a longitudinal framing member and a plurality of longitudinally spaced apart transverse flanges supporting the longitudinal flanges on the base part, the transverse flanges defining therebetween transverse framing channels for receiving transverse framing members, and fastener receiver means molded integrally into the longitudinal flanges.

The use of integral mounting flanges that are mounted on the top of the flotation base raises the structure that is built onto the float to make optimum use of the buoyancy of the float. This is achieved by arranging the mounting flanges as integral parts of the body shell, supported by themselves and by the body against bending due to side loads on the base part. The structure is thus to be distinguished from floats with framing grooves in the main body of the float structure or which nest into the underside of a dock, platform or the like. With floats that are nested into the bottom of a platform or dock structure, the structure must be at the water level in order to take advantage of the full buoyancy of the flotation devices.

The flanges of the present float are preferably arranged to accept a longitudinal frame element and three cross members, one at each end and one at the centre, each of standard dimensional lumber. With the mounting structure on top of the base, a wide variety of frames can be built directly onto the float. The fastener tubes allow positive fastening of the frame work to the float.

The longitudinal mounting flanges and the supporting transverse flanges allow the mounting structure to wrap around the frame member or members on which the float is mounted, providing a rugged and rigid attachment. The floats may be used at any position on a frame work. They may, for example, be mounted on the edge of the structure supported, with the float projecting to the side as a bumper. Built in steps may be provided between the transverse flanges.

The floats may be molded of any suitable plastic resin, for example, polyethylene, polypropylene or polyvinyl chloride with colorants, ultra violet stabilizers and antioxidants as additives. Polystyrene or polyurethane may also be used. Recycled resins are a good source of raw materials.

The floats may be manufactured economically using rotational molding, blow molding or reaction injection molding. They may also be made by foaming into a mold and spraying a cover coat over the foamed core.

Plastic resin is especially useful for a float since it is rugged and resists deterioration and breakup.

BRIEF DESCRIPTION OF THE DRAWINGS

In the accompanying drawings which illustrate an exemplary embodiment of the present invention.

DETAILED DESCRIPTION

Figure 1:
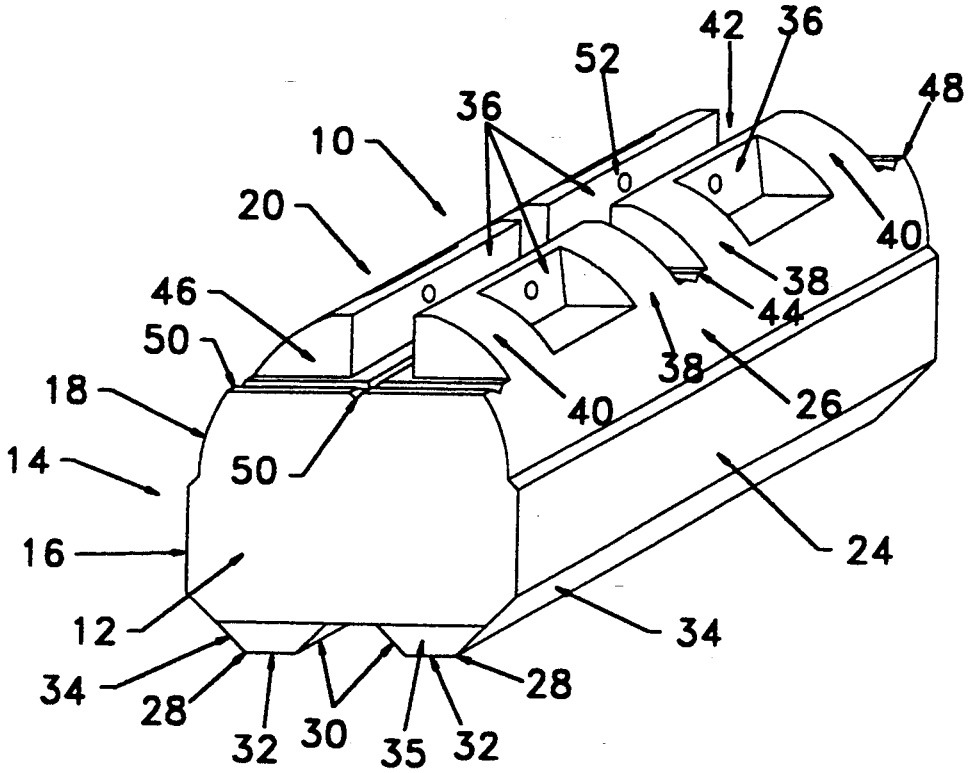
FIG. 1 is an isometric view of a float.

Referring to the accompanying drawings there is illustrated a float 10 composed of a plastic resin shell 12. The float has a base section 14 that includes a lower primary flotation part 16 and an upper secondary flotation part 18. On the top of the base is a frame mounting structure 20 that will be described in more detail in the following.

The float has two flat, parallel ends 22. Along the sides of the primary flotation part 16, it has two fiat, parallel sides 24. The secondary flotation part 18 has part cylindrical sides 26 that converge upwardly and continue into the mounting structure 20.

Along the bottom of the base portion 14 are two longitudinal ribs 28. These extend from end to end of the float. Each includes an inside face 30 that slopes outwardly and downwardly, a fiat centre face 32 and an outside face 34 that slopes outwardly to the respective side 34. The end edges have chamfers 35 to eliminate sharp corners and to make it easier to pull the float and supported structure onto a surface. The ribs provide rigidity along the length of the float and a linear, fiat bottom configuration to support the float if the float and structure that it carries are dragged onto land.

The mounting structure 20 on top of the float includes four longitudinal flanges 36, four transverse flanges 38 in the centre of the float and four transverse flanges 40 at the ends of the float. The longitudinal flanges are arranged into longitudinally spaced pairs, with the floats of each pair being parallel and centreed on the top of the base part 14 of the floats. The pairs of longitudinal flanges 36 are aligned to provide a centre channel 42 along the length of the float, at the centre. The transverse flanges 38 extend outwardly from the ends of the longitudinal flanges and support the ends of the longitudinal flanges. The outer faces of the transverse flanges are upward continuations of the upwardly convergent, curved side faces 26. The transverse flanges thus merge into the top of the float body to transfer into the body shell any forces acting to bend the longitudinal flanges outwards. Consequently, any side loads on the body, for example from waves, will not twist the float body on the mounting flanges. The entire shell of the float, including the mounting flanges, is a unitary, structurally rigid shell.

At the centre of the float, the transverse flanges 38 are longitudinally spaced to provide a transverse channel 44 of the same depth as the longitudinal channel 42. At either end of the float, the transverse flanges 40 are offset from the respective float ends to provide end notches 46 and 48 to accommodate further frame members.

A drainage groove 50 extends along the base of each of the channels 42 and 44 and along the base of each of the notches 46 and 48 to drain water away from the frame member.

Figure 5:
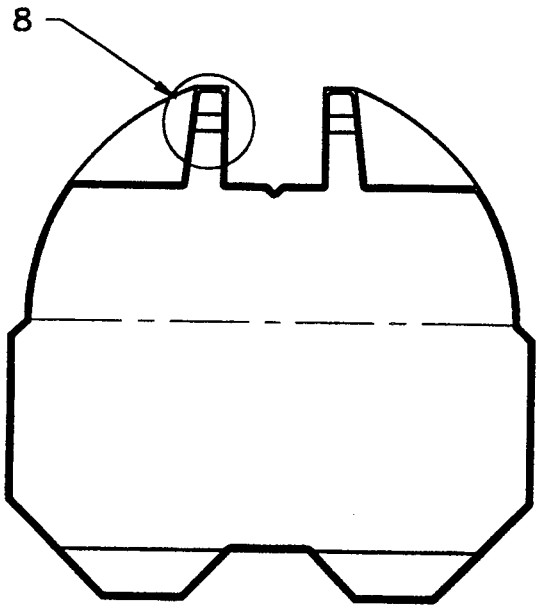
FIG. 5 is a cross-section along line 5—5 of FIG. 3.
Figure 6:
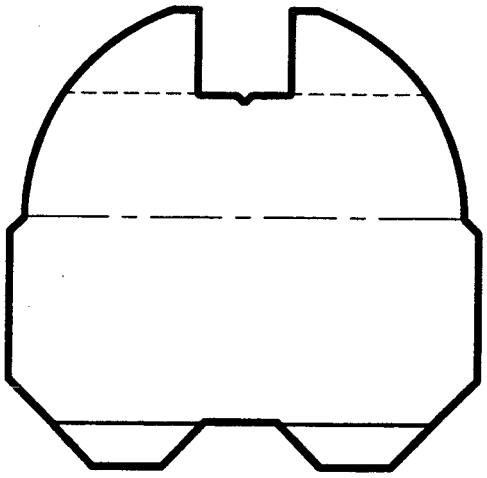
FIG. 6 is cross-sectional along line 6—6 of FIG. 3.
Figure 7:
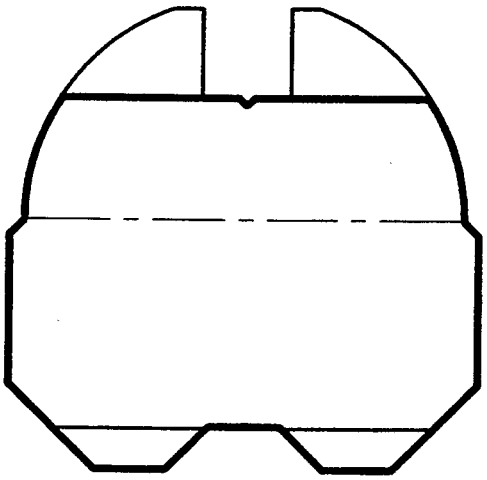
FIG. 7 is cross-sectional along line 7—7 of FIG. 3.
Figure 8:
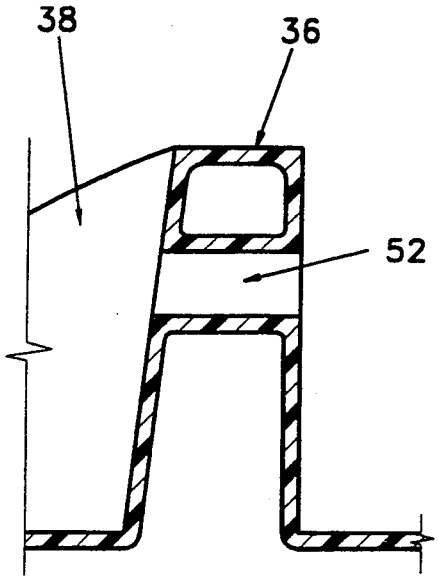
FIG. 8 is a detailed view showing the circled area "8" of FIG. 5.

Each of the longitudinal flanges 36 has a molded-in fastener receiving tube 52. This extends transversely through the centre of the flange as illustrated most particularly in FIGS. 5 and 8. The tubes accommodate fasteners such as screws or through bolts for fastening the frame members in place in the channel 42. Frame members seated in the transverse channel 44 and the end notches 48 are connected to the frame members in the channel 42.

Figure 2:
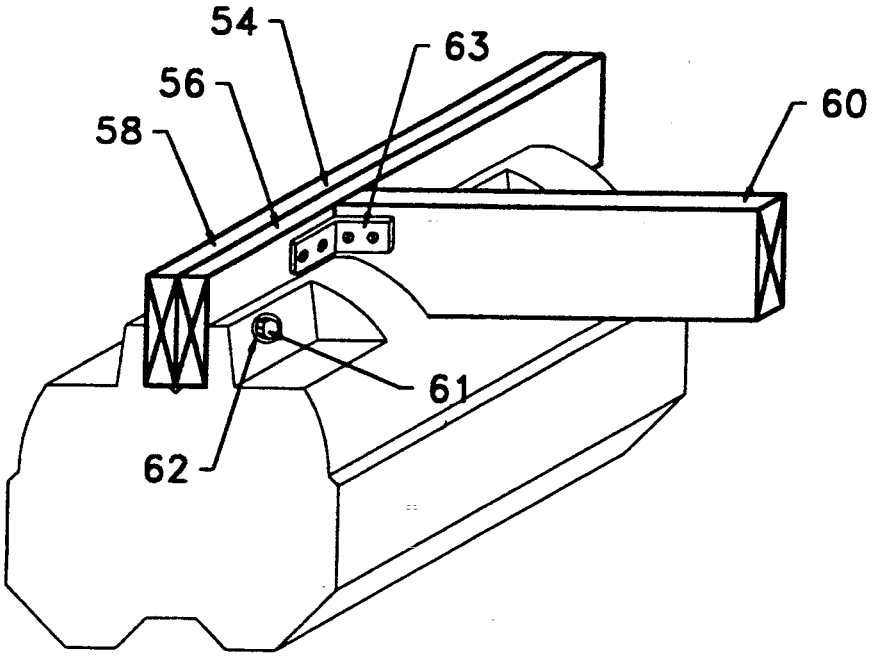
FIG. 2 is an isometric view of a float with frame elements attached.
Figure 3:
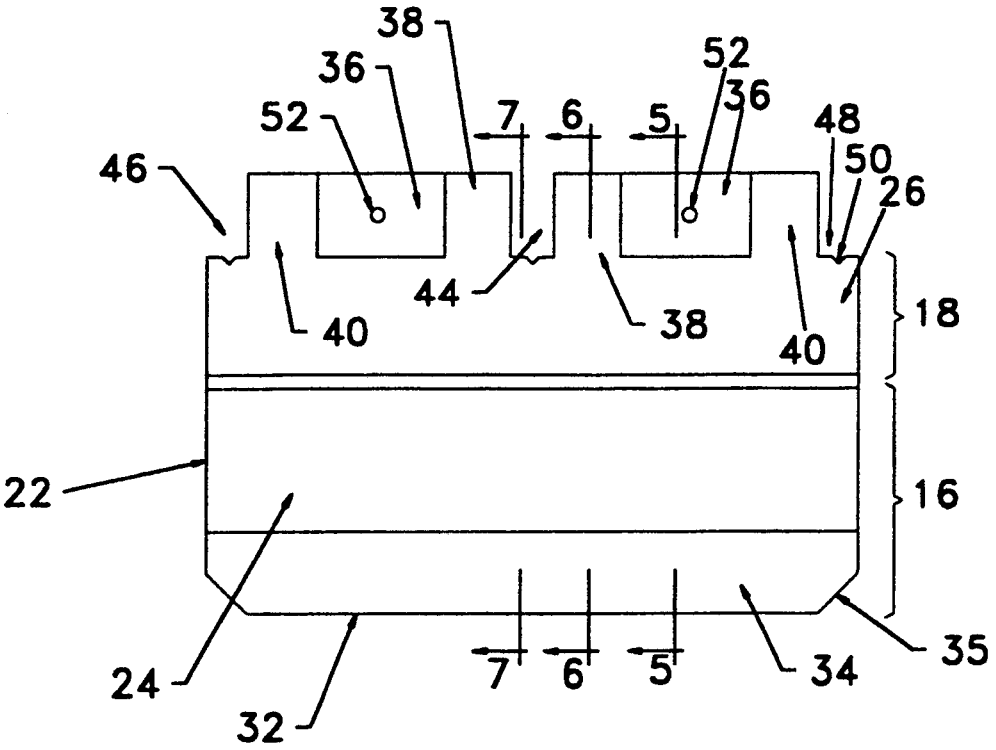
FIG. 3 is a side elevation of a float.
Figure 4:
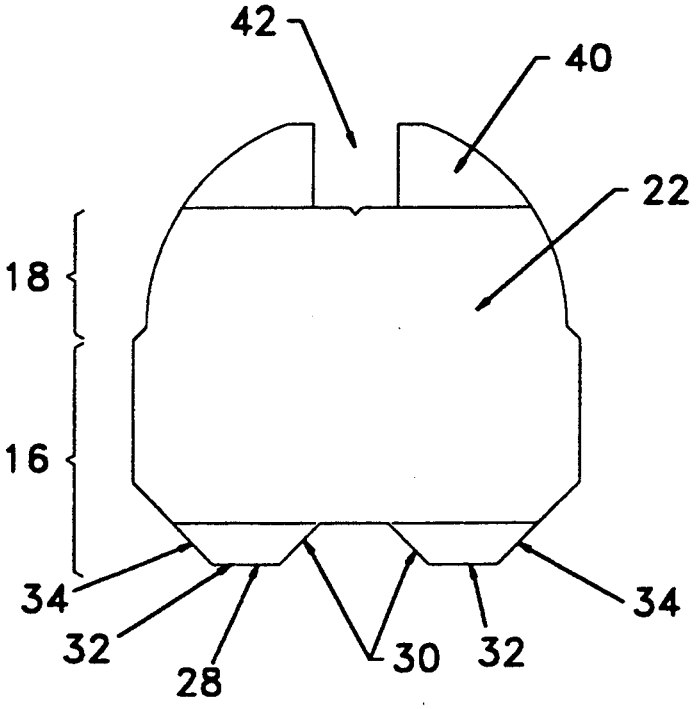
FIG. 4 is an end view of a float.
Figure 9:
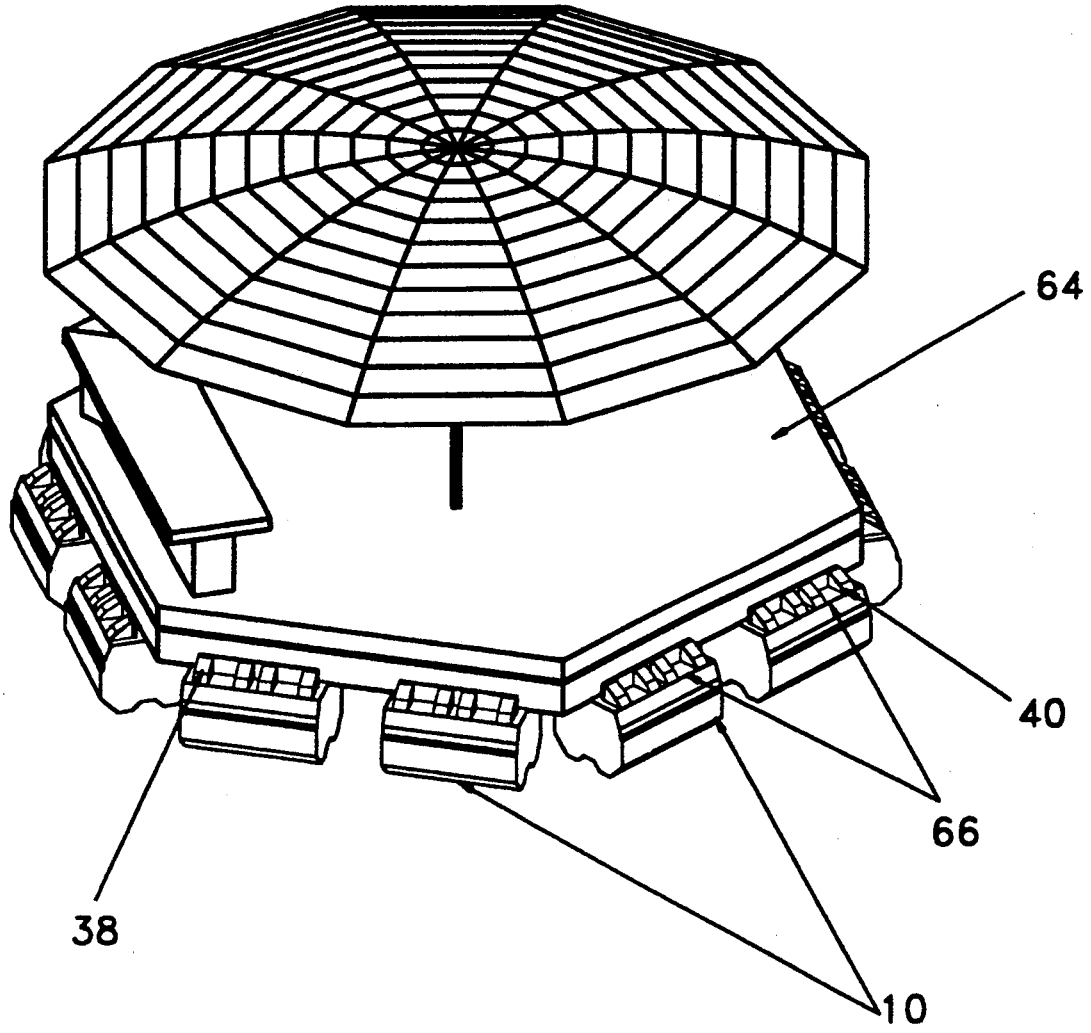
FIG. 9 illustrates a gazebo platform supported on floats according to the present invention.
Figure 10:
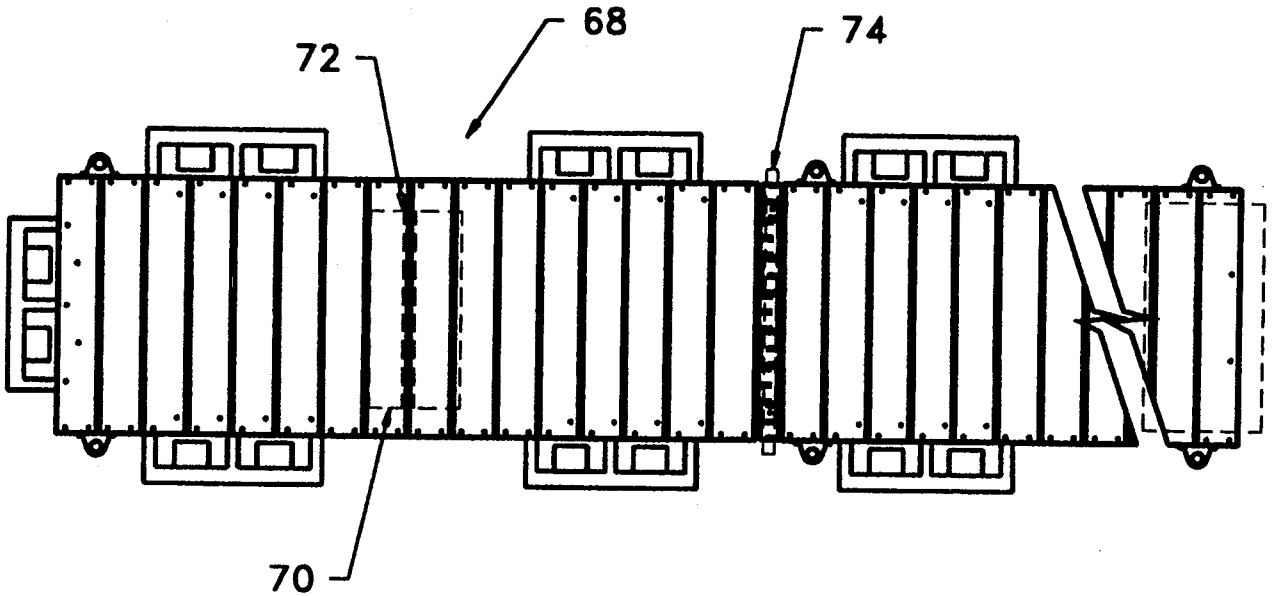
FIG. 10 illustrates a dock supported on floats according to the present invention.

The manner of mounting frame members on the float is illustrated in FIGS. 2, 9 and 10. In FIG. 2, a longitudinal framing member 54 consisting of two side by side lengths 56 and 58 of 2×6 dimension lumber extends along the channel 42. A transverse frame element 60 extends into the channel 44 to abut against the side of the framing member 54. Fasteners in the form of screws 61 and galvanized washers 62 fasten the frame member 54 in the channel 42, while the 2×6 transverse frame element 60 is connected to the longitudinal frame member 54 using a reinforcing angle 63.

FIG. 9 illustrates the use of the floats in supporting a gazebo platform 64. The floats are fastened to the frame around the periphery of the platform. The area between two adjacent transverse flanges 38 and 40 is a flat surface on top of the float base that can be used as a step 66 for stepping from a boat to the platform. The projection of the float beyond the side of the platform provides a bumper or fender function that prevents direct contact between the boat and the wooden gazebo structure.

FIG. 10 illustrates a dock 68 constructed with floats according to the invention. As with the gazebo, the floats are connected to the framing around the perimeter of the dock. An additional float is mounted under the dock on a cross brace 72. A section of dock as illustrated may be used alone or it may be connected to other dock sections, rigidly joined or using a hinge arrangement 74.

Figure 11:
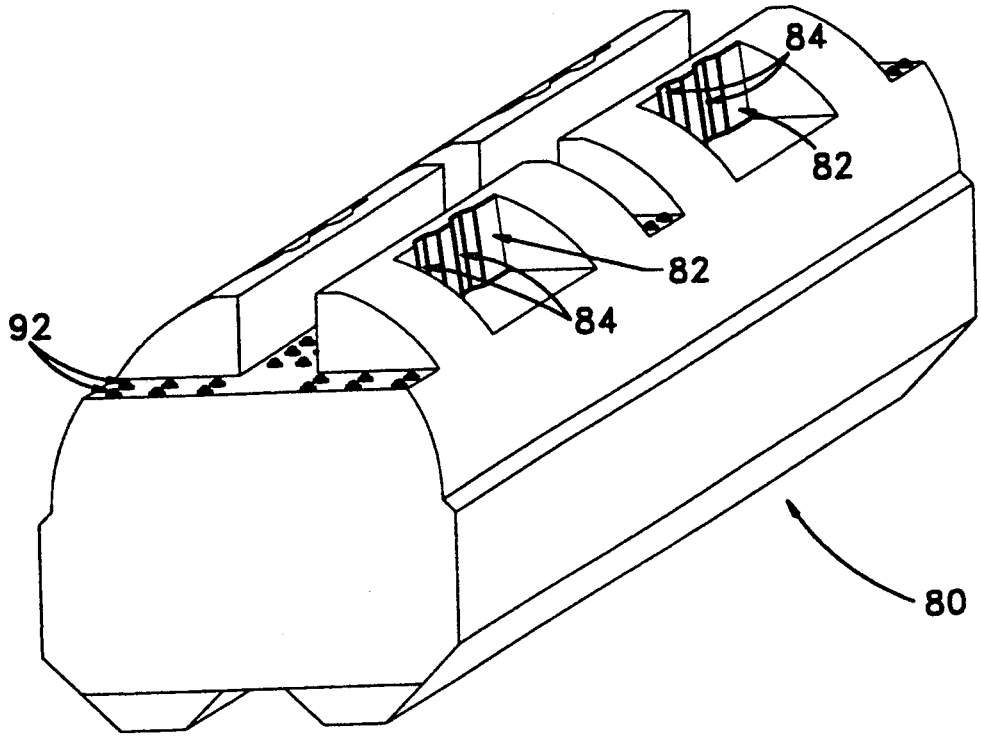
FIG. 11 is an isometric view of an alternative embodiment of the float.
Figure 12:
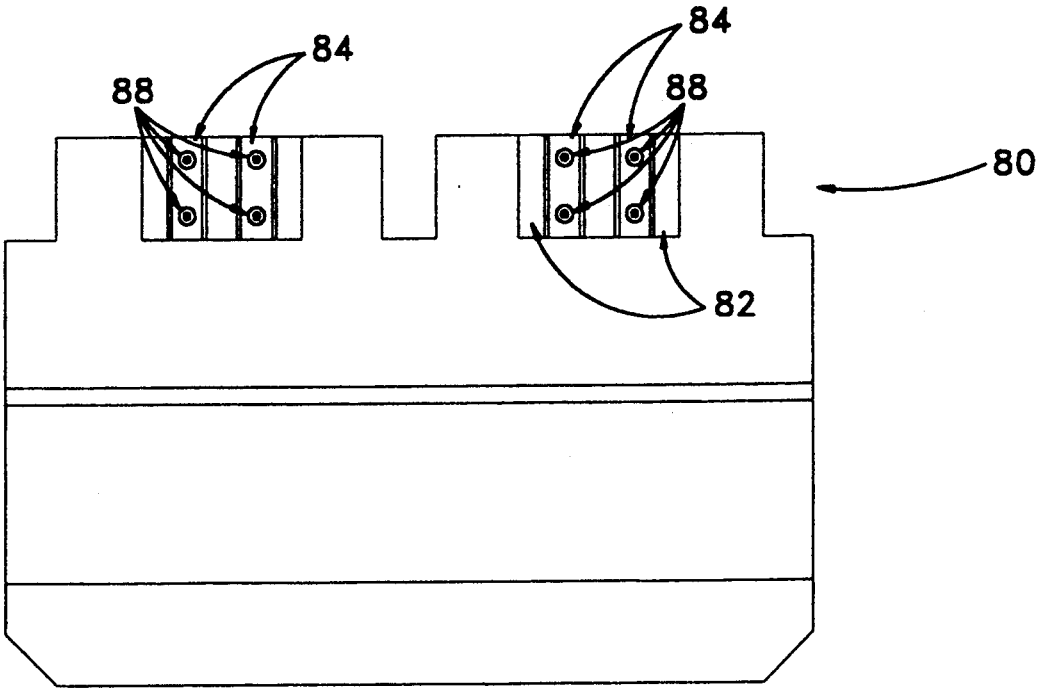
FIG. 12 is a side view of the embodiment of FIG. 11.
Figure 13:
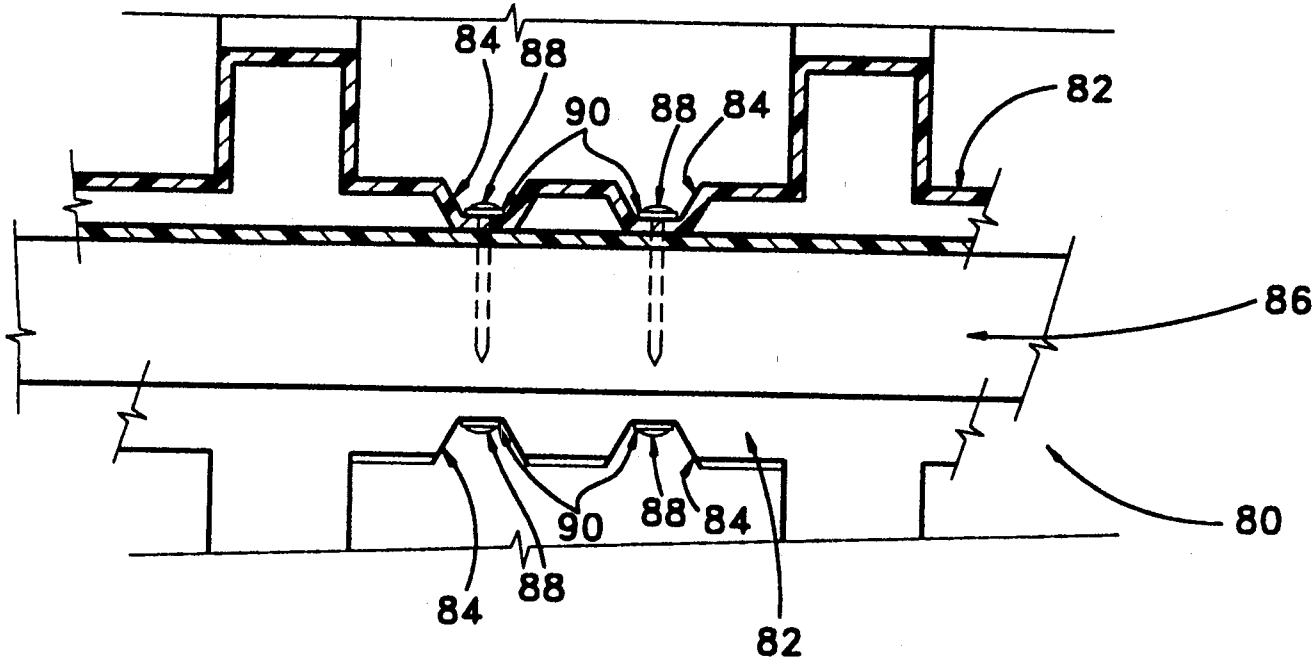
FIG. 13 is a part sectional view showing the mounting of a structural member on the embodiment of FIGS. 11 and 12.

Another embodiment of the float is illustrated in FIGS. 11, 12 and 13. In that embodiment, the fastener retaining tubes are omitted. In the alternative float 80, the outer faces of the longitudinal flanges 82 have channel-shaped recesses 84 as fastener receivers. these are sufficiently deep that the plastic material of the inner and outer walls of the flanges kiss and are sealed to one another as shown in FIG. 13. The float is then fastened to a structural member 86 by a screw 88 through the channels in the flanges 82 and into the structural member. Washers 90 are used under the heads of the screws to reduce local pressures on the plastic material. Two recesses 84 are provided in each of the longitudinal flanges, extending the full height of the flange in order to accommodate four screws per flange, two in each channel.

The embodiment of FIGS. 11, 12 and 13 also incorporates an alternative drainage mechanism for the channels. In this embodiment, small bosses 92 are distributed over the bases of the longitudinal and transverse channels, and the end notches. These support the frame members above puddles of water on the channel bases.

Multipurpose floats of the present invention may be used in whatever quantity or configuration that a user may wish. Regardless of the dock or platform configuration, the floats can be mounted on most any frame component to provide the desired buoyancy. The configuration of the base portion of the device is such as to provide optimum water displacement and thus optimum buoyancy while the frame mounted on the float is still well above the water surface. By the time the supported structure reaches the water surface, the floats will be almost fully submerged, providing the maximum available buoyancy.

Notwithstanding the benefits of using the float in the upright, horizontal position, it is also possible to use it in any other orientation desired. It may, for example, be arranged sideways, with a frame element attached to the side, vertically, end to end or upside down.

The floats may be, at the option of the user, either hollow or foam filled.

While one particular embodiment of the present invention has been described in the foregoing, it is to be understood that other embodiments are possible within the scope of the invention. The invention is to be considered limited solely by the scope of the appended claims.

We claim:

1. An aquatic float comprising a molded shell of plastic resin having a base part with longitudinally spaced ends and transversely spaced sides, and a plurality of integral frame mounting elements on the top of the base part, the mounting elements including transversely spaced apart longitudinal flanges, spaced inwardly from the sides of the base part, the longitudinal flanges defining between them a centre channel for receiving a longitudinal framing member, and a plurality of longitudinally spaced apart transverse flanges extending outwardly from the longitudinal flanges towards the sides of the base part and supporting the longitudinal flanges on the base part, the transverse flanges defining therebetween transverse framing channels for receiving transverse framing members, and fastener receiver means molded integrally into the longitudinal flanges.

2. A float according to claim 1 wherein the longitudinal flanges comprise four longitudinal flanges arranged in longitudinally spaced apart pairs.

3. A float according to claim 2 wherein the transverse flanges comprise four transverse flanges defining a transverse centre channel.

4. A float according to claim 3 wherein the transverse flanges comprise four further transverse flanges, with respective pairs of the further flanges located at respective longitudinally opposite ends of the longitudinal flanges and spaced from the ends of the base part to provide notches for receiving transverse frame members at the ends of the float.

5. A float according to claim 1 wherein the base part comprises transversely spaced apart, longitudinal bottom ribs.

6. A float according to claim 5 wherein the base part comprises, above the ribs, a primary floatation part with substantially vertical sides.

7. A float according to claim 6 wherein the base part comprises, above the primary floatation part, a secondary floatation part with sides that are offset transversely inwardly from the sides of the primary floatation part.

8. A float according to claim 1 wherein the shell is filled with a buoyant foam.

9. A float according to claim 1 wherein the fastener receiver means comprise fastener receiving tubes extending transversely through the longitudinal flanges.

10. An aquatic float comprising a molded shell of plastic resin having a base part with longitudinally spaced ends and transversely spaced sides, and a plurality of integral frame mounting elements on the top of the base part, the mounting elements including transversely spaced apart longitudinal flanges defining a centre channel for receiving a longitudinal framing member, and a plurality of longitudinally spaced apart transverse flanges supporting the longitudinal flanges on the base part, the transverse flanges defining therebetween transverse framing channels for receiving transverse framing members, and fastener receiver means molded integrally into the longitudinal flanges, the base part having at least one flat step surface located between two longitudinally adjacent transverse flanges.

11. An aquatic float comprising a molded shell of plastic resin having a base part with longitudinally spaced ends and transversely spaced sides, and a plurality of integral frame mounting elements on the top of the base part, the mounting elements including transversely spaced apart longitudinal flanges defining a centre channel for receiving a longitudinal framing member, and a plurality of longitudinally spaced apart transverse flanges supporting the longitudinal flanges on the base part, the transverse flanges defining therebetween transverse framing channels for receiving transverse framing members, and fastener receiver means molded integrally into the longitudinal flanges, the fastener receiver means comprising potions of the longitudinal flanges in which inner and outer walls of the flanges are in sealing contact.

12. A floating structure comprising:

a platform including a platform frame comprising plurality of elongate framing members fastened together; and a plurality of floats secured to the frame, each float comprising a molded plastic resin shell having a base part with longitudinally spaced ends and transversely spaced sides, a plurality of integral frame mounting elements on the top of the base part, the frame mounting elements comprising longitudinally extending, transversely spaced apart longitudinal flanges, spaced inwardly from the sides of the base part, the longitudinal flanges defining between them a centre channel engaging the framing member, a plurality of transverse flanges extending outwardly from the longitudinal flanges towards the sides of the base part and supporting the longitudinal flanges on the base part, at least one fastener receiver means integrally molded into each longitudinal flange and fasteners extending through the receiver means into the associated framing members for securing the floats to the framing members.

13. A structure according to claim 12 wherein the longitudinal flanges include four longitudinal flanges arranged in two longitudinally spaced pairs with a gap therebetween, the transverse flanges comprising at least four flanges arranged in transversely spaced apart pairs, projecting to opposite sides from the longitudinal flanges and with the transverse flanges of each pair being longitudinally spaced on opposite sides of said gap to receive a transverse framing member therebetween.

14. A structure according to claim 13 including four additional transverse flanges, each projecting from the side of a respective one of the longitudinal flanges, adjacent the end thereof spaced from said gap, the additional transverse flanges being spaced from the adjacent ends of the float to receive a transverse framing member across the float, adjacent the end thereof.

15. A structure according to claim 12 wherein the base part comprises transversely spaced, longitudinally extending bottom fibs.

16. A structure according to claim 15 wherein the base part comprises a primary floatation part with substantially vertical sides.

17. A structure according to claim 16 where the base part comprises, above the primary floatation part, a secondary floatation part with sides offset transversely inwardly from the sides of the primary floatation part.

18. A structure according to claim 12 wherein the shell is filled with a buoyant foam.

19. A float according to claim 12 wherein the fastener receiver means comprise fastener receiving tubes extending transversely through the longitudinal flanges.

20. A floating structure comprising:

a platform including a platform frame comprising plurality of elongate framing members fastened together; and a plurality of floats secured to the frame, each float comprising a molded plastic resin shell having a base part with longitudinally spaced ends and transversely spaced sides, the base part comprising a primary floatation part with substantially vertical sides and, above the primary floatation part, a secondary floatation part with sides offset transversely inwardly from the sides of the primary floatation part, a plurality of integral frame mounting elements on the top of the base part, the frame mounting elements comprising longitudinally extending, transversely spaced apart longitudinal flanges defining a centre channel engaging the framing member, a plurality of transverse flanges supporting the longitudinal flanges on the base part, at least one fastener receiver means integrally molded into each longitudinal flange and fasteners extending through the receiver means into the associated framing members for securing the floats to the framing members, the base part having at least one flat step surface between two longitudinally adjacent transverse flanges.

21. A floating structure comprising:

a platform including a platform frame comprising plurality of elongate framing members fastened together; and a plurality of floats secured to the frame, each float comprising a molded plastic resin shell having a base part with longitudinally spaced ends and transversely spaced sides, a plurality of integral frame mounting elements on the top of the base part, the frame mounting elements comprising longitudinally extending, transversely spaced apart longitudinal flanges defining a centre channel engaging the framing member, a plurality of transverse flanges supporting the longitudinal flanges on the base part, at least one fastener receiver means integrally molded into each longitudinal flange and fasteners extending through the receiver means into the associated framing members for securing the floats to the framing members, the fastener receiver means comprising potions of the longitudinal flanges in which inner and outer walls of the flanges are in sealing contact.

* * * * *